US005625858A

United States Patent [19]

Hirai et al.

[11] Patent Number: 5,625,858

[45] Date of Patent: Apr. 29, 1997

[54] CONTACT CHARGING MEMBER, PROCESS FOR PRODUCING SAME AND ELECTROPHOTOGRAPHIC APPARATUS USING SAME

[75] Inventors: Yoshihiro Hirai, Ibaraki-ken; Takashi Yamashita, Nagareyama; Masaaki Takenaka, Kashiwa, all of Japan

[73] Assignees: Canon Kabushiki Kaisha, Tokyo; Canon Kasei Kabushiki Kaisha, Ibaraki-ken, both of Japan

[21] Appl. No.: 586,091

[22] Filed: Jan. 16, 1996

[30] Foreign Application Priority Data

Jan. 18, 1995 [JP] Japan ..... 7-005729

[51] Int. Cl.[6] ..... G03G 15/02

[52] U.S. Cl. ..... 399/176; 492/56

[58] Field of Search ..... 355/219; 361/225; 492/56; 29/895.212, 895.32

[56] References Cited

U.S. PATENT DOCUMENTS 5,567,494 10/1996 Ageishi et al. ..... 355/219 X

FOREIGN PATENT DOCUMENTS

| | | |
|---|---|---|
| 56-104349 | 8/1981 | Japan . |
| 63-167380 | 3/1988 | Japan . |
| 64-24264 | 1/1989 | Japan . |
| 3-59682 | 3/1991 | Japan . |
| 5-2313 | 1/1993 | Japan . |

*Primary Examiner*—Joan H. Pendegrass

*Attorney, Agent, or Firm*—Fitzpatrick, Cella, Harper & Scinto

[57] ABSTRACT

A contact charging member to be abutted against a charge-receiving member and supplied with a voltage for charging the charge-receiving member is provided. The charging member includes an electroconductive substrate, an elastic layer and a surface layer disposed in lamination. The surface layer comprises crosslinked polymer crosslinked by irradiation with an electron beam. The surface layer may preferably be in the form of a seamless tube formed of the crosslinked polymer. The surface layer crosslinked by electron beam irradiation is less liable to suffer from transfer of a crosslinking agent or a decomposition product thereof to the charge-receiving member. Accordingly, the charging member shows improved durability and stably uniform charging ability suitable for electrophotographic image formation under various environmental conditions.

16 Claims, 2 Drawing Sheets

CONTACT CHARGING MEMBER, PROCESS FOR PRODUCING SAME AND ELECTROPHOTOGRAPHIC APPARATUS USING SAME

FIELD OF THE INVENTION AND RELATED ART

The present invention relates to a charging member for charging a charge-receiving member (a member to be charged) in contact with the charge-receiving member, a process for production thereof and an electrophotographic apparatus using the charging member.

In an image forming apparatus including an electrophotographic apparatus (such as a copying machine or a printer) and an electrostatic recording apparatus, a corona discharger has principally been used heretofore, as means for non-contactively charging the surface of an image-carrying member as a charge-receiving member including a photosensitive member, a dielectric material, etc. Such a corona discharger has an advantage of excellent uniform charging ability.

However, the corona discharger requires an expensive high-voltage power supply and a space for, e.g., shielding itself or the high-voltage power supply. Further, it is accomplished with occurrence of relatively much corona-discharge by-products, such as ozone, so that it also requires auxiliary means and mechanism for dealing with the by-products, thus resulting in an increase in size and production cost of the apparatus.

For such reasons, a charging means of the contact charging-type has been increasingly adopted. The contact charging is a process for charging a charge-receiving member surface to prescribed polarity and voltage by causing a charging member under application of a voltage to contact the charge-receiving member, and is accompanied with advantages, such as a lower voltage of power supply, little occurrence of by-products, such as ozone, as encountered in corona-discharging, and a simpler cost leading to a lower production cost.

Depending on the shape and form of the charging member used, the contact charging device may be classified into a roller-type charger using a charging member in the form of a roller (charging roller) (as disclosed in, e.g., Japanese Laid-Open Patent Application (JP-A) 63-167380 and JP-A 56-91253); a blade-type charger including a blade-shaped member (charging blade) (as disclosed in, e.g., JP-A 64-24264 and JP-A 56-104349), and a brush-type charger including a brush-shaped member (as disclosed, e.g., in JP-A 64-24264).

The charging member can be supplied with a DC voltage alone (DC voltage application scheme), but may preferably be subjected to a scheme (AC voltage application scheme) wherein a charge-receiving member is charged by forming an oscillating electric field (alternating electric field or AC electric field, e.g., an electric field or voltage of which the voltage value periodically changes with time) having a peak-to-peak voltage which is at least two times a charging initiation voltage of the charge-receiving member at the time of applying DC voltages to the contact charging member, because it is possible to effect a uniform charging treatment.

The charging roller in the roller-type charger is rotatably held about an axis and is pressed against the charge-receiving member surface at a prescribed pressure so as to rotate following the movement of the charge-receiving member surface.

The charging roller ordinarily has a multi-layer structure comprising a core metal at the center, an electroconductive elastic layer in the form of a roller disposed to surround the core metal, and a surface layer disposed on the outer peripheral surface thereof.

In the above structure, the core metal is a rigid body for retaining the entire shape of a roller and also functions as an electricity-supplying electrode layer.

The elastic layer ordinarily comprises an electroconductive member having a volume resistivity of $10^4$–$10^9$ ohm.cm and also has a function of ensuring a uniform contact with the charge-receiving member surface through its elastic deformation. Accordingly, the elastic layer ordinarily comprises a vulcanized rubber having a resiliency as represented by a rubber hardness (JIS A) of at most 70 degrees.

The surface layer has functions of improving the uniform chargeability of the charge-receiving member, preventing the occurrence of leakage attributable to pinholes, etc., on the charge-receiving member surface, preventing the sticking of toner particles or paper dust and preventing the bleeding out of oil or a plasticizer added to the elastic layer for lowering the hardness thereof. The surface layer may have a volume resistivity of $10^5$–$10^{13}$ ohm.cm and has been conventionally formed by applying an electroconductive paint.

Further, in view of the condition for use thereof, the charging member is required to be surfaced with a material having good mechanical strength, wear resistance, ozone resistance, and heat and cold resistance, and having a low moisture-absorptivity, a good resiliency, a creep resistance, a low compression permanent strain and an easy processability.

If the surfacing material does not satisfy the above-mentioned properties, the charging roller is liable to deteriorate during the use or cannot fit to a change in-environmental condition to result in image defects.

Further, in case where an oscillating electric field is formed between the charger and the charge-receiving member so as to effect the uniform charging of the charge-receiving member, it is possible that a mechanical oscillation is induced therebetween to cause an abnormal sound, which may be called a charging sound and the suppression of which has imposed an important problem.

The charging sound may be effectively reduced by lowering the rubber hardness of the elastic layer, but it is difficult to accomplish a sufficient lowering in hardness by simply increasing the amount of the softening agent. Accordingly, it has been considered to use a rubber foam or a spongy rubber. The thus-formed charging roller may be referred to as a foam-type charging roller, and another type using no foam material may be referred to as a solid-type charging roller.

In the case of a foam-type charging roller, a surface skin layer formed at the time of vulcanization is liable to have a poor surface smoothness, so that the skin layer has to be removed by an abrasion treatment. However, as the uniformization of a bubble or cell size is difficult, a large size of bubble is liable to be exposed at the surface by the abrasion, resulting in a concavity in the surface layer formed by application in the subsequent step. Such a surface concavity formed in the surface layer of a charging roller results in a charging failure and fails in providing good images.

On the other hand, there has been proposed a method wherein a polymeric material is preliminarily formed into a seamless tube and is then used to cover an elastic layer to form a surface layer (JP-A 3-59682 and JP-A 5-2313).

In the case of using a seamless tube described above, the resultant surface layer can be free from a concavity even if the elastic layer therebelow is accompanied with a large bubble, thus providing a charging roller excellent in surface smoothness. However, the surface layer also has many functions as described above, so that it is also required to have excellent mechanical strength, wear resistance, ozone resistance and hot-and-cold resistance.

SUMMARY OF THE INVENTION

A generic object of the present invention is to provide a contact charging member excellent in physical properties as described above.

Another object of the present invention is to provide a process for producing such a contact charging member.

A further object of the present invention is to provide an electrophotographic apparatus using such a contact charging member.

According to the present invention, there is provided a contact charging member to be abutted against a charge-receiving member and supplied with a voltage for charging the charge-receiving member, comprising an electroconductive substrate, an elastic layer and a surface layer disposed in lamination; said surface layer comprising a crosslinked polymer crosslinked by irradiation with an electron beam.

According to another aspect of the present invention, there is also provided a process for producing a contact charging member to be abutted against a charge-receiving member and supplied with a voltage for charging the charge-receiving member, comprising the steps of:

(1) forming an elastic layer on an electroconductive substrate, (2) shaping a polymer into a seamless tube, (3) crosslinking the polymer in the shape of the seamless tube by irradiation with an electron beam, and (4) covering the elastic layer with the crosslinked seamless tube.

According to a further aspect of the present invention, there are provided an electrophotographic apparatus and a process cartridge for such an electrophotographic apparatus, respectively including a contact charging member as described above.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
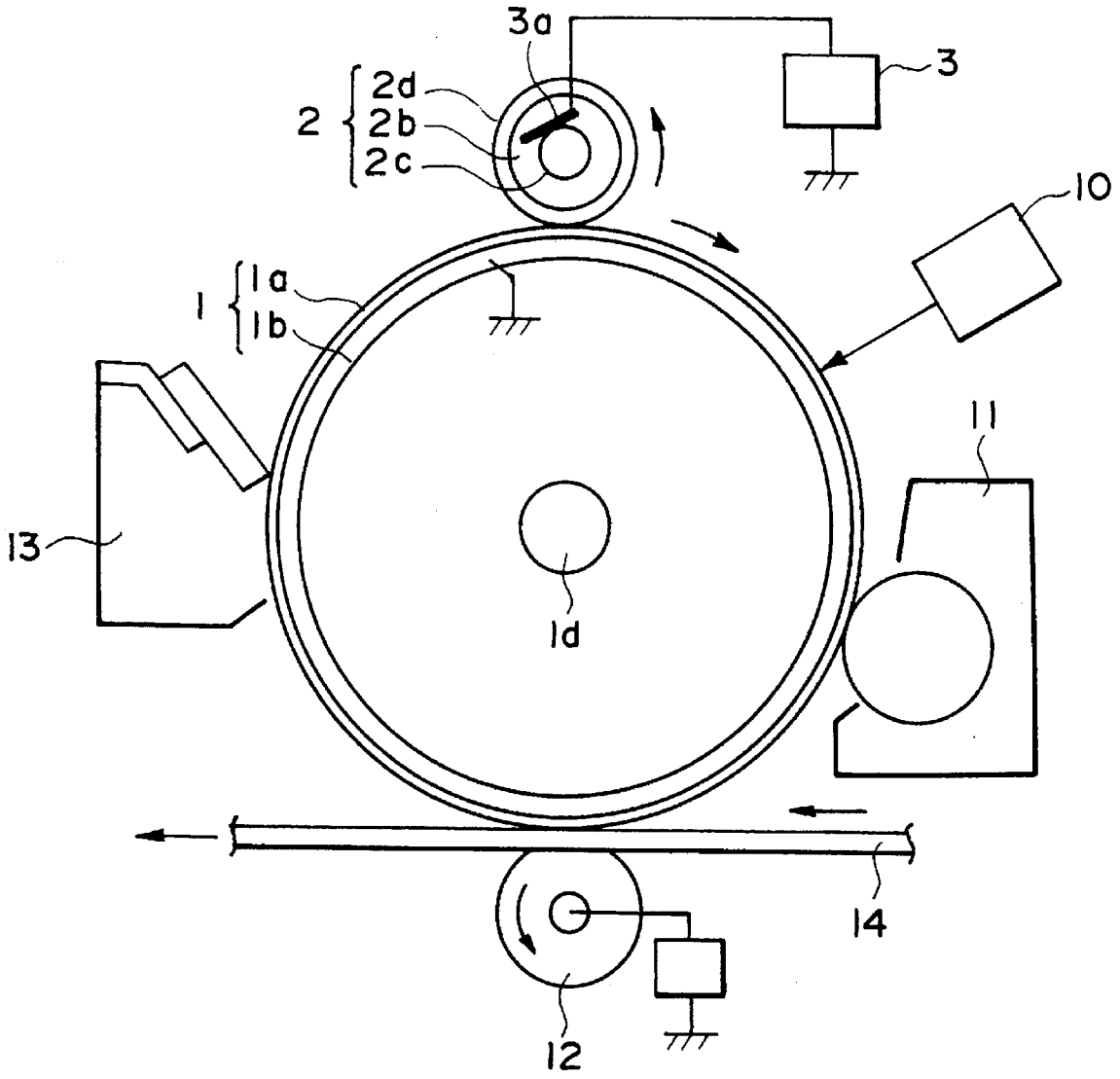
FIG. 1 is a schematic illustration of a transfer-type electrophotographic apparatus including a contact charging member according to the invention.

The elastic layer constituting the contact charging member according to the present invention may comprise an electroconductive rubber composition principally comprising an elastic material and a conductivity-imparting agent.

The elastic material may appropriately comprise: a rubber, such as silicone rubber, ethylene-propylene rubber, EPDM (ethyl/propyl/diene terpolymer) fluorinated rubber, urethane rubber, epichlorohydrin rubber, epichlorohydrin-ethylene oxide rubber, acrylic rubber, ethylene-acrylic rubber, natural rubber, isoprene rubber, butadiene rubber, 1,2-polybutadiene, styrene-butadiene rubber, chloroprene rubber, nitrile rubber, modified nitrile rubber, butyl rubber, chlorosulfonated polyethylene rubber, polysulfide rubber, or chlorinated polyethylene rubber; or a thermoplastic elastomer of styrene-type, olefin-type, ester-type, urethane-type, isoprene-type, 1,2-butadiene-type, vinyl chloride-type, amide-type, ionomer-type, etc.

The conductivity-imparting material for imparting an electroconductivity to the elastic layer may comprise a known material. Examples thereof may include: carbon fine particles inclusive of carbon black and graphite particles; fine particles of metals, such as nickel, silver, aluminum, and copper; fine particles composed principally of metal oxides, such as tin oxide, zinc oxide, titanium oxide, aluminum oxide and silica, doped with impurity ions having different atomic valences; electroconductive fiber such as carbon fiber, fiber of metal such as stainless steel, electroconductive whisker, such as carbon whisker and electroconductive potassium titanate whisker obtained surface-treating potassium titanate whisker with a metal oxide, carbon, etc., for electroconductivity imparting; and fine particles of electroconductive polymers, such as polyaniline and polypyrrole.

The elastic layer containing a conductivity-imparting material may ordinarily be formed adjacent to a core metal as an electroconductive substrate or electricity-supplying electrode (layer) to assume a shape of roller. Hereinafter, such a core metal and elastic layer may be integrally called a roller member.

The elastic layer may be formed through processes which are not particularly restricted but may be ordinary rubber-shaping process, such as injection molding, extrusion and press-forming. The core and the elastic layer may be integrated with each other by directly forming the elastic layer surrounding the core metal by the insert molding process or by shaping the elastic layer in the form of a thick tube and inserting the core metal into the thick tube.

It is possible to reduce the rigidity of the elastic layer by incorporating a softening agent, such as an oil or plasticizer, in the above-mentioned electroconductive rubber composition. As another method, the rigidity of the elastic layer may be reduced by forming the elastic layer of a rubber foam.

It is important that the elastic layer has a macroscopically smooth surface. Accordingly, in case where the elastic layer does not have a sufficiently smooth surface after its formation, e.g., when it is formed as a rubber foam or with a spew line as by the press forming process, a secondary smoothening treatment as by abrasion or trimming may be required.

Further, as the elastic layer is ordinarily pressed against the charge-receiving member, it is desired that the elastic layer has small compression permanent strain. Accordingly, the elastic layer may desirably be formed of a vulcanized rubber or a crosslinked rubber.

The polymer constituting the surface layer of the contact charging member according to the present invention may suitably comprise various rubbers or thermoplastic elastomers as described above for constituting the elastic layer. The polymer may also be a plastic material, examples of which may include: polyolefins, such as polyethylene, ethylene copolymers, polypropylene, propylene/ethylene copolymer, polybutene, and poly-4-methyl-pentene-1; polyamides, such as nylon 6, nylon 66, nylon 11, nylon 12 and other copolymer nylons; saturated polyesters, such as PET (polyethylene terephthalate) and PBT (polybutylene terephthalate); polycarbonate; styrene-type resins, such as polystyrene, HIPS (high-impact polystyrene), ABS (acrylonitrile/butadiene/styrene copolymer), AES (acrylonitrile/EPDM/styrene), and AAS (acrylonitrile/acrylate/styrene); acrylic resins; vinyl chloride resins; vinylidene chloride resins; polyacetal; polyphenylene oxide and polystyrene-modified products thereof; polyimide resins; polyallylate; and vinylidene fluoride homopolymers and copolymers. It is further possible to use a polymer alloy or a polymer blend including two or more species of polymers, selected from the above-mentioned rubbers, thermoplastic elastomers and plastic materials.

The surface layer can be formed by applying such a crosslinkable polymer onto the elastic layer surface and irradiating the polymer layer with an electron beam or electron rays to cause crosslinking reaction.

The surface layer may also be formed by first shaping such a polymer into a seamless tube and then covering the elastic layer with the seamless tube of the polymer. More specifically, the seamless tube may be prepared by subjecting a polymer comprising such a polymer, a conductivity imparting agent as described above and another optional additive, as desired, to the extrusion forming, the injection molding, the blow forming, etc., to form a tube of the composition. Among the above, the extrusion forming is particularly suited.

The polymer layer or tube simply formed according to the forming or shaping process described above cannot sufficiently satisfy the properties required for the surface layer or the surface layer material. Accordingly, the polymer is crosslinked by irradiation with an electron beam or electron rays. For the crosslinking, there has been known the chemical crosslinking process wherein a crosslinking agent, such as sulfur, an organic peroxide or an amine, appropriately selected depending on the polymer, is added to the polymer composition, and then the polymer composition is heated. The electron beam crosslinking is advantageous than the chemical crosslinking process because it requires no or less crosslinking agent and is less liable to of soil the charge-receiving member with the crosslinking agent or decomposition products thereof and no requirement for high-temperature treatment, and than the γ-ray crosslinking because of the safety of the process.

The crosslinked polymer thus-obtained may be provided with improved wear resistance, heat resistance and anti-creep characteristic compared with the corresponding non-crosslinked polymer, thus being expected to satisfy the properties required of the surface layer.

Figure 2:
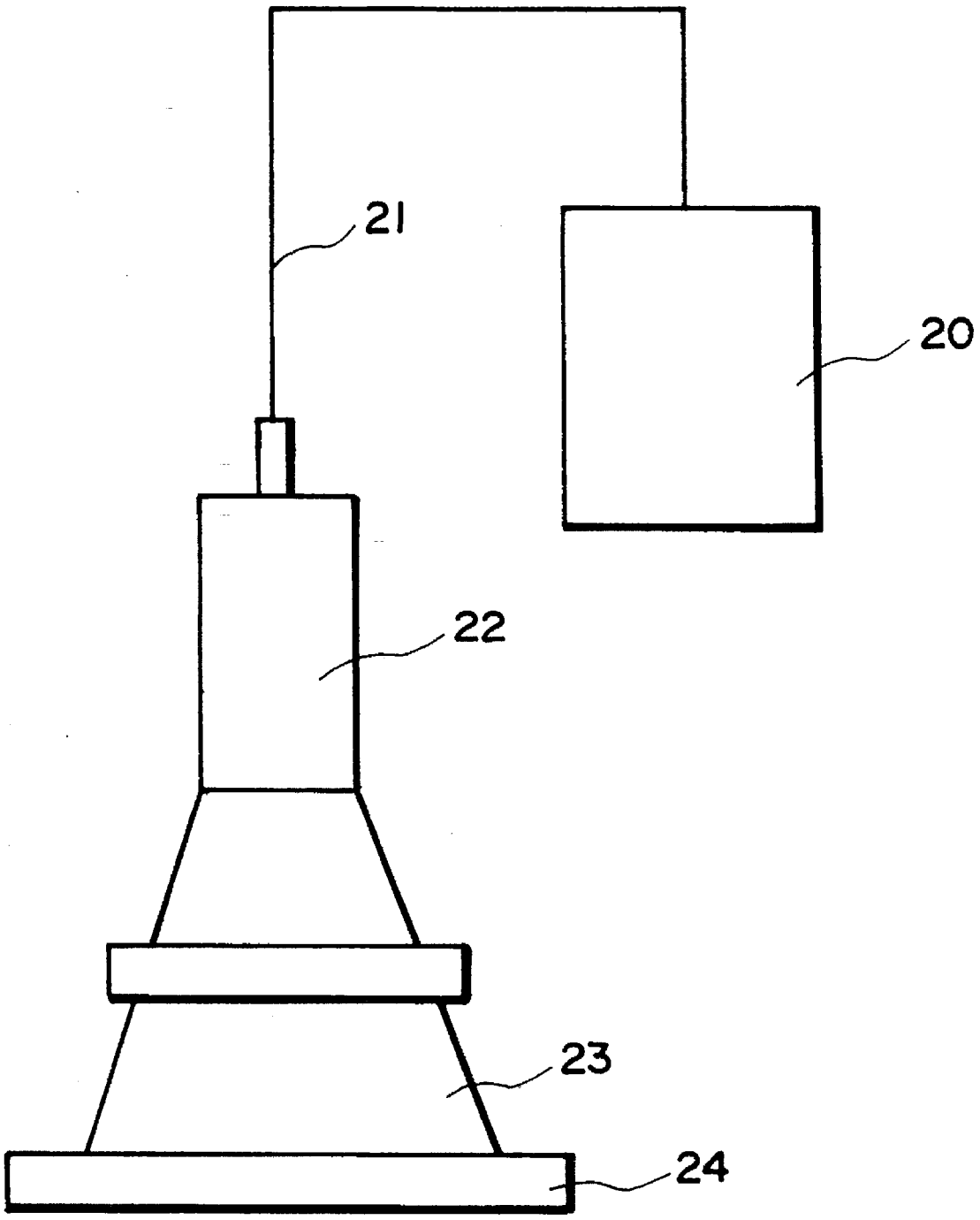
FIG. 2 is an illustration of an electron beam irradiation apparatus suitably used in the invention.

A representative structure of an electron beam irradiation apparatus suitably used for crosslinking in the present invention may be one as shown in FIG. 1. Referring to FIG. 2, an electric power is supplied from a DC power supply 20 via a cable 21 to an accelerating pipe 22, where hot electrons issued from a high-temperature metal filament are accelerated under an accelerating voltage of 150–1000 kV to form a spotty electron beam. The electron beam is supplied with a high-frequency magnetic field, when it passes through a scanner, to form a scanning electron beam, which is then omitted through a window to irradiate an object to be crosslinked, i.e., a polymer tube or coating, disposed directly below the window.

The crosslinking by electron beam irradiation may be effected it various points of time during the tube formation. More specifically, the crosslinking may be effected either after the tube formation and before the insertion of a roller member, or after the insertion of a roller member. Further, in the case of forming the surface layer by wet coating, it is generally preferred to once dry the polymer coating film and then irradiate the coating film with an electron beam.

In the electron beam crosslinking process, it is sometimes desirable to add a crosslinking aid depending on the species of a polymer to be crosslinked so as to provide the crosslinked polymer with improved physical properties.

Preferred examples of the crosslinking aid may include polyfunctional monomers, such as triallyl isocyanurate, tetraethylene glycol dimethacrylate, divinylbenzene, diallyl phthalate, trimethylolpropane, trimethacrylate, trimethylpropane triacrylate, triallyl cyanurate, tetramethylolmethane tetramethacrylate, and trimethoxyethoxyvinylsilane.

Ordinarily, the irradiation dose may suitably be in the range of 5–50 Mrad (corresponding to 12 to 120 calorie per gram of the polymer) but may be selected at an appropriate level depending on factors, such as the species of a polymer the presence or absence of a crosslinking aid and the accelerating voltage level.

The crosslinking seamless tube may preferably have a thickness of 100–500 μm, more preferably 150–350 μm.

On the other hand, the surface layer prepared through the wet coating process may suitably have a thickness of 10–150 μm.

The surface layer in its state after being finished into the surface layer of the charging member may preferably have a resistivity of $10^5$–$10^{13}$ ohm.cm, particularly $10^6$–$10^{12}$ ohm.cm.

As described above, a seamless tube for constituting the surface layer may suitably be formed by extrusion. More specifically, the polymer, the electroconductivity-imparting agent and another optional additive, such as a crosslinking agent and/or stabilizer are formulated into a compound in advance, which compound is then knead and extruded by an extruder and extruded through a die having a ring-shaped slit, followed by cooling to continuously form a seamless tube.

A heat-shrinkable tube may be prepared if the tube size is enlarged, e.g., by air-pressurization during the cooling or re-heating after the cooling, or a non-heat-shrinkable tube may be prepared if such a size-enlarging treatment is not applied.

The seamless tube used in the present invention may be either non-heat-shrinkable or heat-shrinkable but can be used to cover the elastic layer in different manners depending on whether it is either of the two.

In the case of a non-heat-shrinkable tube, the tube is required to have an inner diameter which is at most the outer diameter of the elastic layer so as to ensure an intimate attachment between the elastic layer and the surface layer and, while the tube diameter is enlarged by blowing a compressed air, the roller member is inserted into the tube, followed by releasing the air pressure to complete the insertion or coverage with the tube.

On the other hand, in the case of a heat-shrinkable tube, the tube may desirably have an inner diameter larger than the outer diameter of the elastic layer and, after being inserted with the roller member, are caused to thermally shrink about the elastic layer to effect an intimate attachment, e.g., by heating for a prescribed period in a thermostat vessel held at a temperature in the vicinity of the softening point thereof, to complete the insertion or coverage of the roller member.

Next, a further description is added regarding respective polymers.

Polyethylene, which is ordinarily a homopolymer of ethylene, may be classified into low-density polyethylene or high-density polyethylene depending on a different degree of crystallization. As a special grade, it is also possible to use a copolymer of ethylene with a polar polymer, examples of which may include vinyl acetate, acrylic monomer such as methyl methacrylate or acrylic acid, maleic anhydride, vinyl chloride and vinylsilane. In recent years, a copolymer with α-olefin, such as 1-butene (linear low-density polyethylene) has also been used. Herein, the above-mentioned homopolymer and copolymers of ethylene may be included in polyethylene.

Polyethylene has many excellent properties but has a poor heat resistance so that, when it is used to constitute a surface layer of a charging roller in its uncrosslinked state, the resultant surface layer deforms due to creep, thus losing its surface smoothness.

In addition to the above-mentioned conductivity-imparting agent, the crosslinked polyethylene can further contain various optional additives, such as a stabilizer, a lubricant and insulating fillers, as desired.

Polyamides may include nylon 12 which is generally produced by polycondensation of ω-laurolactam or 12-aminodecanoic acid, and nylon 11 which is generally produced by polycondensation of 11-aminoundecanoic acid.

The above-mentioned two species of polyamides, i.e., nylon 12 and nylon 11, have remarkably different molecular structures compared with general purpose polyamides, such as nylon 6 and nylon 66, and are excellent in softness, wear resistance and low-temperature property and have low moisture-absorptivity, which are suited for constituting the surface layer of a charging member.

To the nylon 12 or nylon 11, it is possible to add various stabilizers and insulating fillers, as desired, in addition to the above-mentioned charge-imparting agent.

The electron beam curing of a polyamide may be promoted by preliminary addition of an allyl compound such as triallyl isocyanurate, so as to allow effective crosslinking by electron beam irradiation in air.

Ethylene-acrylic rubber, which is a relatively novel rubber first commercialized by E. I. Dupont in 1975, may be regarded as a type of acrylic rubber in a broad sense but has a significant difference in molecular structure from ordinary acrylic rubber and correspondingly has remarkably characteristic physical properties.

The ethylene-acrylic rubber principally comprise a binary copolymer of ethylene and methyl acrylate and is ordinarily commercially available as a ternary copolymer including a carboxylic compound as a third monomer. The ethylene-acrylic rubber may be either a binary or ternary copolymer as described above.

The ethylene-acrylic rubber has advantageous properties inclusive of (1) a good heat resistance well in balance with oil resistance, (2) better low-temperature characteristic than acrylic rubber and (3) good weather resistance and ozone resistance. The ethylene-acrylic rubber also has a large mechanical strength, small compression permanent strain and good flexural resistance.

In addition to the above-mentioned conductivity-imparting agent, it is also possible to add a vulcanizer, a filler, an aging inhibitor, a promoter, or a processing aid, as desired, to the ethylene-acrylic rubber.

Examples of the filler for the ethylene-acrylic rubber may ordinarily include: carbon black, fumed colloidal anhydrous silica, calcium carbonate, barium sulfate, and titanium dioxide. However, other inorganic or organic fillers can also be added.

As the aging inhibitor, a diphenylamine-type or phenol-type anti-oxidant may ordinarily be used.

Chlorinated polyethylene is a thermoplastic polymer prepared by chlorinating polyethylene. Chlorinated polyethylene is rich in ozone resistance, softness, heat resistance, etc.

In addition to the above-mentioned conductivity-imparting agent, it is possible to add a stabilizer and various insulating fillers to the chlorinated polyethylene. Suitable examples of the stabilizer may include: ordinary organotin compounds, epoxy compounds, lead compounds, metallic soaps and metal oxide.

Epichlorohydrin-ethylene oxide rubber is formed by copolymerization of nearly equal mols of epichlorohydrin and ethylene oxide, and is a synthetic rubber having good heat resistance, cold resistance and ozone resistance in combination. The epichlorohydrin-ethylene oxide rubber used in the present invention may also include a ternary copolymer further including a small amount of alkyl glicidyl ether as a crosslinking monomer.

The above-mentioned binary and ternary copolymers have remarkably improved the low-temperature property which has been a defect of epichlorohydrin homopolymer.

In addition to the above-mentioned conductivity-imparting agent, it is also possible to add a vulcanizer, an aging inhibitor, a various insulating filler and a processing aid, as desired, to the epichlorohydrin-ethylene oxide rubber.

Chlorosulfonated rubber is a synthetic rubber developed by E. I. Dupont in 1951 and is obtained by reaction of polyethylene with chlorine and sulfurous acid gas. The chlorosulfonated polyethylene has a molecular structure as represented by the following formula:

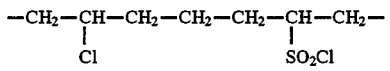

Chlorosulfonated polyethylene has excellent ozone resistance, heat resistance, mechanical strength and wear resistance and also has small compression permanent strain.

Modified nitrile rubber is a blend rubber or a synthetic rubber developed for improving the poor ozone resistance of nitrile rubber (i.e., acrylonitrile-butadiene copolymer, NBR), and examples thereof may include a blend of nitrile rubber and polyvinyl chloride (NBR/PVC), a blend of nitrile rubber and EPDM (NBR/EPDM), hydrogenated nitrile rubber and carboxylated nitrile rubber, which are all commercially easily available.

Among the modified nitrile rubber, NBR/PVC can be obtained as a blend rubber showing advantageous properties comprising a compatible blend of NBR and PVC in almost any ratios because NBR and PVD have polar groups which are chemically similar to each other. Particularly, the NBR/PVC has remarkably improved ozone resistance and improved flexure resistance and wear resistance compared with NBR. Further, NBR/PVC has also improved extrusion processability compared with NBR and provides a shaped product having a surface which is smooth and shows a fine gloss.

NBR/EPDM is a blend rubber relatively recently developed in 1970's, has improved the ozone resistance of NBR by utilization of excellent ozone resistance of EPDM and also has good processability and mechanical properties.

Hydrogenated nitrile rubber is a rubber obtained by hydrogenating a large number of double bonds contained in the main chain of NBR (nitrile rubber) in a specific manner to lower the degree of unsaturation thereof, and has improved ozone resistance, heat resistance, cold resistance, mechanical strength, wear resistance and processability.

The contact charging member according to the present invention can assume any shape inclusive of those of a roller and a blade, which may be selected depending on a requirement of an electrophotographic apparatus for which it is adopted.

FIG. 1 is a schematic cross-sectional view of an embodiment of an electrophotographic apparatus including the contact charging member according to the present invention.

Referring to FIG. 1, a drum-type electrophotographic photosensitive member 1 is used as a charge-receiving member or charge-carrying member and comprises an electroconductive support layer 1*b* of, e.g., aluminum, and a photoconductive layer 1*a* formed on the support layer 1*b*. The photosensitive member 1 is rotated about an axis 1*d* at a prescribed peripheral speed in the clockwise direction. The photosensitive member 1 is uniformly charged by means of a roller-type charging member 2 for performing primary charging by contact to have prescribed polarity and potential at the surface thereof. The charging member 2 comprises a core metal (or a shaft) 2*c* as an electroconductive support, an elastic layer 2*b* and a surface layer 2*d* disposed in this order. The core metal 2*c* has both end sections at which the core metal is rotatably supported by a bearing member (not shown). The core metal 2*c* is disposed parallel to the axis l*d*, and the charging member 2 is caused to abut upon the photosensitive member 1 under a prescribed pressure exerted by a pressing member (not shown), such as a spring, thus rotating mating with the rotation of the photosensitive member 1.

The primary charging is performed by applying a DC bias voltage or a superposition of a DC bias voltage and an AC bias voltage to the core metal 2*c* through a friction (or rubbing) electrode 3*a* by means of a power supply 3, thus contactively providing the peripheral surface of the rotating photosensitive member 1 with a prescribed polarity and a prescribed potential.

The peripheral surface of the photosensitive member 1 uniformly charged by the charging member 2 as described above is then subjected to imagewise exposure (e.g., laser beam scanning exposure or slit exposure of an original image) by image exposure means 10, whereby an electrostatic latent image corresponding to objective image data is formed on the peripheral surface of the photosensitive member 1. The thus formed latent image is developed or visualized by developing means 11 with a toner to form a toner image (or developed image) in sequence.

The toner image is successively transferred to the front side of a transfer-receiving material 14 such as paper, and is timely conveyed from a paper supply part (not shown) to a transfer position between the photosensitive member 1 and transfer means 12 (i.e., transfer roller in this embodiment) in synchronism with the rotation of the photosensitive member 1, by the transfer means 12. The transfer means (roller) 12 is used for charging the back side of the transfer-receiving material 14 so as to have a polarity opposite to that of the toner, whereby the toner image formed on the photosensitive member 1 is transferred to the front side of the material 14.

Then, the transfer-receiving material 14 having thereon the toner image is detached from the surface of the photosensitive member 1 and is conveyed to fixing means (not shown), whereby it is subjected to image fixing to be outputted as an image product.

The surface of the photosensitive member 1 after the transfer operation is subjected to cleaning by cleaning means 13 for removing and recovering an attached matter, such as a residual toner, from the surface of the photosensitive member 1, thus obtaining a cleaned surface to prepare for the next cycle.

In the present invention, a plurality of elements, such as a photosensitive member, a charging member, a developing means and a cleaning means, of an electrophotographic apparatus as shown in FIG. 1 can be integrally assembled to form a process cartridge, so that the cartridge may be detachably mountable to the apparatus main body. For example, the charging member according to the present invention and optionally one or both of the developing means and the cleaning means may be integrally assembled with the photosensitive member into a process cartridge, so that the cartridge may be attached to or detached from the apparatus body by the medium of a guiding means, such as a rail, of the apparatus body.

The charging member according to the present invention may be used as transfer means, primary charging means or discharge (or charge-removal) means, or further as a conveyer means, such as a paper supply roller.

The electrophotographic apparatus including the charging member according to the present invention may be embodied as a copying apparatus, a laser beam printer, an LED printer, or an electrophotography application apparatus, such as an electrophotographic plate-forming system.

Hereinbelow, the present invention will be descried more specifically with reference to Examples, wherein "part(s)" means "part(s) by weight".

EXAMPLE 1

A roller member having an elastic layer was prepared in the following manner.

100 parts of EPDM ("EPT4045", mfd. by Mitsui Sekiyu Kagaku K.K.), 10 parts of zinc white No. 1 (valcanization promoter and reinforcing agent), 2 parts of stearic acid, 2 parts of promoter M (2-mercaptobenzothiazole), 1 part of promoter BZ (zinc dibutyldithiocarbamate), 2 parts of sulfur, 5 parts of foaming agent ("CELLMIKE C", mfd. by Sankyo Kasei K.K.), 5 parts of foaming aid ("CELLTON NP", Sankyo Kasei K.K.), 20 parts of FEF (Fast Extrusion Furnace) carbon, 70 parts of insulating oil (paraffin oil). and 8 parts of electroconductive carbon ("ketjen black EC", mfd. by Lion K.K.) were blended and then kneaded for dispersion by a two-roller mill to form a rubber compound. The rubber compound was wound about an iron-made core metal preliminarily coated with a primer and then placed in a mold for pre-forming at 40° C. and 100 kg/cm$^2$ followed by vulcanization at 160° C. for 30 min. to form a roller member of a foam-type covered with a skin layer.

Then, the skin layer was removed by grinding with a grinder to complete a roller member having a core metal diameter of 6 mm, an outer diameter of 12 mm, a core metal length of 250 mm and an elastic layer length of 230 mm.

The resistance of the roller member was measured by placing the roller member on an aluminum sheet and put a load of 500 grams on each end to apply a total load of 1 kg to measure a resistance of $2\times10^6$ ohm.cm between the core metal and the aluminum sheet.

The roller member thus prepared was coated with a surface layer 2*a* (as shown in FIG. 1) by inserting the roller member into a preliminarily-formed non-heat-shrinkable tube of electroconductive polyethylene crosslinked by electron beam irradiation.

More specifically, an electroconductive polyethylene compound was prepared by blending 100 parts of high-pressure polyethylene ("SUNTEC LD L6810", mfd. by Asahi Kasei K.K.), 10 parts of a conductivity-imparting agent (carbon black "#4500", mfd. by Tohkai Carbon K.K.) and 2 parts of zinc stearate and melt-kneading the blend through an extruder to form a seamless tube product.

Then, the tube was irradiated with 200 M rad of electron beam at an accelerating voltage of 250 kV by means of an electron beam irradiator ("CURETRON", mfd. by Nisshin High-voltage K.K.).

The thus-obtained electroconductive crosslinked non-heat-shrinkable polyethylene tube had an inner diameter of 11.5 mm, a thickness of 250 μm and a volume resistivity of $1\times10^6$–$1\times10^8$ ohm.cm.

The above-prepared roller member was inserted into the non-heat shrinkable tube while blowing compressed air into the tube, thereby forming a surface layer (2*a* in FIG. 1) intimately fitting the circumference of the elastic layer of the roller member, thereby completing a charging roller.

The charging roller was incorporated in a process cartridge ("EP-L", available from Canon K.K.), which was mounted in a laser beam printer ("Laser Shot A404", mfd. by Canon K.K.) and subjected to a continuous image formation test of 10,000 sheets in respective environments of H/H (high temperature/high humidity of 32.5° C./80% RH), N/N (normal temperature/normal humidity of 25.0° C./50% RH) and L/L (low temperature/low humidity of 15.0° C./10% RH), whereby the resultant images gave the evaluation results shown in the following Table 1.

TABLE 1

| Environment | H/H | N/N | L/L |
|---|---|---|---|
| initial | o | o | o |
| 3000 sheets | o | o | o |
| 6000 sheets | o | o | o |
| 10000 sheets | o | o | o |

The images were evaluated with eyes according to the following standard similarly as the results shown in Tables appearing hereinafter.

o: No images were accompanied with image defects, such as sanded fog, black spots and pinholes.

Δ: Nearly a half of the product images were accompanied with any one of the above-mentioned image defects.

x: Almost all of the product images were accompanied with any one of the above-mentioned image defects.

EXAMPLE 2

An electroconductive nylon 12 compound was prepared in the same manner as in Example 1 except for using 100 parts of nylon 12 ("Diamide L1700", mfd. by Daicel Huels K.K.) in place of the polyethylene, additionally using 2 parts of triallyl isocyanurate (crosslinking aid) and changing the amount of the carbon black to 8 parts. Then, the compound was formed into a seamless tube in the same manner as in Example 1 except for changing the die temperature to 250° C. and was crosslinked by irradiation with 10 M rad of electron beam at an accelerating voltage of 150 kV.

The roller member prepared in Example 1 was inserted into the above prepared electroconductive crosslinked non-heat-shrinkable nylon 12 tube while blowing compressed air into the tube to complete a charging roller. As a result of continuous image formation in the same manner as in Example 1, the laser beam printer including the charging roller provided the evaluation results shown in the following Table 2.

TABLE 2

| Environment | H/H | N/N | L/L |
|---|---|---|---|
| initial | o | o | o |
| 3000 sheets | o | o | o |
| 6000 sheets | o | o | o |
| 10000 sheets | o | o | o |

EXAMPLE 3

An electroconductive ethylene-acrylic rubber compound was prepared in the following manner.

100 parts of ethylene-acrylic rubber ("BAYMAC D", mfd. by Showa Denko Dupont K.K. ), 1 part of diphenylamine-type antioxidant ("NOWGUARD 445"), 2 parts of stearic acid, 0.5 part of alkyl phosphate, 0.5 part of octadecylamine, 20 parts of FEF carbon, 2 parts of ketjen black EC (conductivity-imparting agent) and 2 parts of triallyl isocyanurate were blended and kneaded for dispersion by a two-roller mill to form a rubber compound in the form of a sheet.

The rubber compound was extruded by an extruder through a die having a ring-shaped slit heated at 75° C. and cooled to form a seamless tube.

The tube was crosslinked by irradiation with 10 M rad of electron beam at an accelerating voltage of 250 kV.

The electroconductive non-heat-shrinkable ethylene-acrylic rubber tube had an inner diameter of 11.5 mm, a thickness of 300 μm and a volume resistivity of $1\times10^6$–1× 108 ohm.cm.

The roller member prepared in Example 1 was inserted into the above-prepared electroconductive non-heat-shrinkable tube while blowing compressed air into the tube to complete a charging roller. As a result of continuous image formation in the same manner as in Example 1, the laser beam printer including the charging roller provided the evaluation results shown in the following Table 3.

TABLE 3

| Environment | H/H | N/N | L/L |
|---|---|---|---|
| initial | o | o | o |
| 3000 sheets | o | o | o |
| 6000 sheets | o | o | o |
| 10000 sheets | o | o | o |

EXAMPLE 4

An electroconductive polypropylene/EPDM compound was prepared in the same manner as in Example 1 except for using a polymer blend of 70 parts of polypropylene ("MA7", mfd. by Mitsubishi Yuka K.K.) and 30 parts of EPDM ("EPT 4045", mfd. by Mitsui Sekiyu Kagaku K.K.) in place of the polyethylene and additionally using 2 parts of triallyl isocyanurate (a crosslinking aid). Then, the compound was formed into a seamless tube in the same manner as in Example 1 except for changing the die temperature to 220° C. and was crosslinked by irradiation with 10 M rad of electron beam at an accelerating voltage of 150 kV.

The roller member prepared in Example 1 was inserted into the above-prepared electroconductive crosslinked non-heat-shrinkable polypropylene/EPDM tube while blowing compressed air into the tube to complete a charging roller. As a result of continuous image formation in the same manner as in Example 1, the laser beam printer including the charging roller provided the evaluation results shown in the following Table 4.

TABLE 4

| Environment | H/H | N/N | L/L |
|---|---|---|---|
| initial | o | o | o |
| 3000 sheets | o | o | o |
| 6000 sheets | o | o | o |
| 10000 sheets | o | o | o |

COMPARATIVE EXAMPLE 1

A charging roller was prepared in the same manner as in Example 1 except that the electroconductive polyethylene seamless tube after the formation thereof was directly subjected to the roller member insertion without the electron beam irradiation.

As a result of continuous image formation in the same manner as in Example 1, the laser beam printer including the charging roller provided the evaluation results shown in the following Table 5.

TABLE 5

| Environment | H/H | N/N | L/L |
|---|---|---|---|
| initial | o | o | o |
| 3000 sheets | x | o | x |
| 6000 sheets | x | x | x |

COMPARATIVE EXAMPLE 2

A charging roller was prepared in the same manner as in Example 2 except that the electroconductive seamless tube after the formation thereof was directly subjected to the roller member insertion without the electron beam irradiation.

As a result of continuous image formation in the same manner as in Example 1, the laser beam printer including the charging roller provided the evaluation results shown in the following Table 6.

TABLE 6

| Environment | H/H | N/N | L/L |
|---|---|---|---|
| initial | o | o | o |
| 3000 sheets | o | o | o |
| 6000 sheets | o | o | o |
| 10000 sheets | Δ | o | o |

COMPARATIVE EXAMPLE 3

A charging roller was prepared in the same manner as in Example 3 except that the electroconductive seamless tube after the formation thereof was directly subjected to the roller member insertion without the electron beam irradiation.

As a result of continuous image formation in the same manner as in Example 1, the laser beam printer including the charging roller provided the evaluation results shown in the following Table 7.

TABLE 7

| Environment | H/H | N/N | L/L |
|---|---|---|---|
| initial | x | o | o |
| 3000 sheets | x | x | x |
| 6000 sheets | x | x | x |

COMPARATIVE EXAMPLE 4

A charging roller was prepared in the same manner as in Example 4 except that the electroconductive seamless tube after the formation thereof was directly subjected to the roller member insertion without the electron beam irradiation.

As a result of continuous image formation in the same manner as in Example 1, the laser beam printer including the charging roller provided the evaluation results shown in the following Table 8.

TABLE 8

| Environment | H/H | N/N | L/L |
|---|---|---|---|
| initial | o | o | o |
| 3000 sheets | x | x | x |
| 6000 sheets | x | x | x |

From the results shown in Tables 1–8, it is understood that the charging roller having a surface layer comprising a crosslinked polymer exhibits excellent durability and stably uniform charging ability suitable for electrophotographic image formation under various environmental conditions, thus being suitable for practical use.

Further, as a result of charging noise measurement, all the charging members in Examples 1–4 resulted in a noise below 55 dB, which is of practically no problem at all.

EXAMPLE 5

A heat-shrinkable crosslinked seamless tube ("SUMITUBE G3", mfd. by Sumitomo Denko K.K.) comprising electroconductive chlorinated polyethylene was provided. The heat-shrinkable tube had an inner diameter of 16.5 mm and a thickness of 250 μm.

Then, the roller member prepared in Example 1 was inserted into the heat-shrinkable tube, and the resultant combination was heated for 15 min. in a thermostat vessel at 250° C. having an air atmosphere to cause the tube to shrink about the elastic layer of the roller member, thereby completing a charging roller having an intimately attached surface layer.

The tube after the heat-shrinkage showed a volume resistivity of $1\times10^{6}$–$1\times10^{8}$ ohm.cm.

As a result of continuous image formation in the same manner as in Example 1, the laser beam printer including the charging roller provided the evaluation results shown in the following Table 9.

TABLE 9

| Environment | H/H | N/N | L/L |
|---|---|---|---|
| initial | o | o | o |
| 3000 sheets | o | o | o |
| 6000 sheets | o | o | o |

From the results shown in Table 9, it is understood that the charging roller having a surface layer comprising an electroconductive crosslinked polymer exhibits excellent durability and stably uniform charging ability suitable for electrophotographic image formation under various environmental conditions, thus being suitable for practical use.

Further, as a result of charging noise measurement, the charging member of Example 9 resulted in a noise below 55 dB, which is of practically no problem at all.

EXAMPLE 6

100 parts alcohol-soluble nylon ("CM8000", mfd. by Toray K.K.) were dissolved in a methanol/water mixture solvent to form a vehicle solution having a solid content of 20 wt. %, to which 3 parts of a conductivity-imparting agent (carbon black "#4500", mfd. by Tohkai Carbon K.K.) and 2 parts of triallyl isocyanurate (crosslinking aid) were added and mixed for dispersion by a paint shaker, to obtain an electroconductive paint.

The roller member prepared in Example 1 was dipped in the electroconductive paint, taken out and dried to form a coating film about the roller member.

Then, the coating film on the roller member was irradiated with totally 10 M rad of electron beam by the electron beam irradiator used in Example 1. More specifically, the electron beam irradiation was repeated three times while changing the roller member direction so that the coating polymer was irradiated with a uniform dose of electron beam in the circumferential direction, to complete a charging roller having a surface layer (*2a* in FIG. 1) formed through the wet coating process.

As a result of continuous image formation in the same manner as in Example 1, the laser beam printer including the thus prepared charging roller provided the evaluation results shown in the following Table 10.

TABLE 10

| Environment | H/H | N/N | L/L |
|---|---|---|---|
| initial | o | o | o |
| 3000 sheets | o | o | o |
| 6000 sheets | o | o | o |
| 10000 sheets | o | o | o |

COMPARATIVE EXAMPLE 5

A charging roller was prepared in the same manner as in Example 6 except that the triallyl isocyanurate was omitted from the electroconductive paint and the electron beam irradiation after the drying of the paint was also omitted.

As a result of continuous image formation in the same manner as in Example 1, the laser beam printer including the charging roller provided the evaluation results shown in the following Table 11.

TABLE 11

| Environment | H/H | N/N | L/L |
|---|---|---|---|
| initial | o | o | o |
| 3000 sheets | Δ | Δ | Δ |
| 6000 sheets | x | x | x |

EXAMPLE 7

An electroconductive paint was prepared by dissolving 100 parts of chlorinated polyethylene ("ELASREN 402ANA", mfd. by Showa Denko K.K.) in toluene to form a vehicle solution having a solid content of 5 wt. %, to which 30 parts of a conductivity-imparting agent (electroconductive tin oxide "SN-100", mfd. by Ishihara Sangyo K.K.) was added and mixed for dispersion by a paint shaker.

A charging roller was prepared in the same manner as in Example 6 except for using the thus-prepared electroconductive paint.

As a result of continuous image formation in the same manner as in Example 1, the laser beam printer including the charging roller provided the evaluation results shown in the following Table 12.

TABLE 12

| Environment | H/H | N/N | L/L |
|---|---|---|---|
| initial | o | o | o |
| 3000 sheets | o | o | o |
| 6000 sheets | o | o | o |
| 10000 sheets | o | o | o |

COMPARATIVE EXAMPLE 6

A charging roller was prepared in the same manner as in Example 7 except that the electron beam irradiation after the drying of the paint was omitted.

As a result of continuous image formation in the same manner as in Example 1, the laser beam printer including the charging roller provided the evaluation results shown in the following Table 13.

TABLE 13

| Environment | H/H | N/N | L/L |
|---|---|---|---|
| initial | Δ | o | o |
| 3000 sheets | x | Δ | Δ |
| 6000 sheets | x | x | x |

What is claimed is:

1. A contact charging member to be abutted against a charge-receiving member and supplied with a voltage for charging the charge-receiving member, comprising an electroconductive substrate, an elastic layer and a surface layer disposed in lamination; said surface layer comprising a crosslinked polymer crosslinked by irradiation with an electron beam.

2. A contact charging member according to claim 1, wherein said surface layer comprises a seamless tube formed of the crosslinked polymer.

3. A contact charging member according to claim 1, wherein said surface layer has been formed by applying a coating film of a crosslinkable polymer and crosslinking the coating film by electron beam irradiation.

4. A contact charging member according to claim 1, wherein said crosslinked polymer comprises crosslinked polyethylene.

5. A contact charging member according to claim 1, wherein said crosslinked polymer comprises crosslinked nylon 12 or nylon 11.

6. A contact charging member according to claim 1, wherein said crosslinked polymer comprises crosslinked ethylene-acrylic rubber.

7. A contact charging member according to claim 1, wherein said crosslinked polymer comprises crosslinked polypropylene.

8. A contact charging member according to claim 1, wherein said crosslinked polymer comprises crosslinked chlorinated polyethylene.

9. A contact charging member according to claim 1, wherein said crosslinked polymer comprises crosslinked epichlorohydrin-ethylene oxide rubber.

10. A contact charging member according to claim 1, wherein said crosslinked polymer comprises crosslinked chlorosulfonated polyethylene.

11. A contact charging member according to claim 1, wherein said crosslinked polymer comprises crosslinked modified nitrile rubber.

12. A process for producing a contact charging member to be abutted against a charge-receiving member and supplied with a voltage for charging the charge-receiving receiving member, comprising the steps of:

(1) forming an elastic layer on an electroconductive substrate, (2) shaping a polymer into a seamless tube, (3) crosslinking the polymer in the shape of the seamless tube by irradiation with an electron beam, and (4) covering the elastic layer with the crosslinked seamless tube.

13. An electrophotographic apparatus, comprising: a contact charging member and an electrophotographic photosensitive member; said contact charging member comprising an electroconductive substrate, an elastic layer and a surface layer disposed in lamination; said surface layer comprising a crosslinked polymer crosslinked by irradiation with an electron beam.

14. An electrophotographic apparatus according to claim 13, wherein said surface layer comprises a seamless tube formed of the crosslinked polymer.

15. A process cartridge detachably mountable to a main assembly of an image forming apparatus, comprising an electrophotographic photosensitive member and a charging member integrated with each other to form a cartridge, wherein the charging member comprises an electroconductive substrate, an elastic layer and a surface layer disposed in lamination; said surface layer comprising a crosslinked polymer crosslinked by irradiation with an electron beam.

16. A process cartridge according to claim 15, wherein said surface layer comprises a seamless tube formed of the crosslinked polymer.

* * * * *

UNITED STATES PATENT AND TRADEMARK OFFICE

CERTIFICATE OF CORRECTION

PATENT NO. : 5,625,858

DATED : April 29, 1997

INVENTORS : YOSHIRIHO HIRAI ET AL.

It is certified that error appears in the above-identified patent and that said Letters Patent is hereby corrected as shown below:

ON TITLE PAGE ITEM:

[56] Foreign Patent Documents

"63-167380 3/1988 Japan" should read --63-167380 7/1988 Japan--.

COLUMN 2

Line 35, "in-environmental" should read --in environmental--.

COLUMN 4

Line 20, "obtained" should read --obtained by--;
Line 27, "of" should read --of a--.

COLUMN 5

Line 36, "is" should read --is more--;
Line 38, delete "of";
Line 40, "and" should read --and there is--;
Line 41, "treatment, and than the" should read --treatment. Further, the electron beam crosslinking is better than the--;

UNITED STATES PATENT AND TRADEMARK OFFICE

CERTIFICATE OF CORRECTION

PATENT NO. : 5,625,858

DATED : April 29, 1997

INVENTORS : YOSHIRIHO HIRAI ET AL.

It is certified that error appears in the above-identified patent and that said Letters Patent is hereby corrected as shown below:

COLUMN 5

Line 62, "it" should read --at--.

COLUMN 7

Line 43, "remarkably" should read --remarkable--;
Line 45, "comprise" should read --comprises--.

COLUMN 8

Line 39, "blend" should read --blended--;
Line 48, "blend" should read --blended--;
Line 59, "in 1970's," should read --(in the 1970's),--.

UNITED STATES PATENT AND TRADEMARK OFFICE

CERTIFICATE OF CORRECTION

PATENT NO. : 5,625,858

DATED : April 29, 19997

INVENTORS : YOSHIRIHO HIRAI ET AL.

It is certified that error appears in the above-identified patent and that said Letters Patent is hereby corrected as shown below:

COLUMN 11

Line 36, "with eyes" should read --visually--.

COLUMN 17

Line 15, "receiving" (second occurrence) should be deleted.

Signed and Sealed this

Second Day of December, 1997

*Attest:*

Bruce Lehman

BRUCE LEHMAN

*Attesting Officer*

*Commissioner of Patents and Trademarks*